US005519952A

United States Patent [19]

Kolton et al.

[11] Patent Number: 5,519,952

[45] Date of Patent: May 28, 1996

[54] BELT AND INDICATOR ASSEMBLY

[75] Inventors: Chester Kolton, Westfield; Stuart S. Spater, Livingston, both of N.J.

[73] Assignee: B&G Plastics, Inc., Newark, N.J.

[21] Appl. No.: 180,043

[22] Filed: Jan. 11, 1994

Related U.S. Application Data

[63] Continuation-in-part of Ser. No. 960,941, Oct. 14, 1992, Pat. No. 5,339,552, which is a continuation-in-part of Ser. No. 817,750, Jan. 7, 1992, Pat. No. 5,334,224.

[51] Int. Cl.[6] ..... G09F 23/00

[52] U.S. Cl. ..... 40/640; 40/299

[58] Field of Search ..... 40/636, 27, 630, 40/638, 299, 640

[56] References Cited

U.S. PATENT DOCUMENTS

| | | | |
|---|---|---|---|
| 2,098,164 | 11/1937 | Rice | 40/638 |
| 3,214,852 | 11/1965 | Ford et al. | 40/640 |
| 3,513,575 | 5/1970 | Schiller . | |
| 3,885,334 | 5/1975 | Banks | 40/299 |
| 4,078,660 | 3/1978 | Lerro | 40/640 X |
| 4,112,603 | 9/1978 | Giulie | 40/638 |
| 4,188,427 | 2/1980 | Grass | 40/299 X |
| 4,584,219 | 4/1986 | Baartmans | 40/638 X |
| 4,626,460 | 12/1986 | Duncan . | |
| 5,195,783 | 3/1993 | Lavoie | 283/75 |

*Primary Examiner*—Milton Nelson, Jr.
*Attorney, Agent, or Firm*—Robin, Blecker, Daley & Driscoll

[57] ABSTRACT

A marketing indicator arrangement for application to a belt comprises a strip member having first and second opposed ends, an adhesive layer disposed on a first side of the strip member at the first end thereof, the strip member supporting belt marketing indicia on a second side thereof opposite the adhesive layer and at a location distal from the first end thereof, and a further layer adhered to the second side of the strip member. The marketing indicator arrangement preferably includes a protective layer disposed on the adhesive layer. Further, the marketing indicator arrangement has an additional layer comprised of a material less susceptible to tearing upon perforation thereof following stitching through the marketing indicator than is the strip member.

6 Claims, 2 Drawing Sheets

BELT AND INDICATOR ASSEMBLY

CROSS-REFERENCE TO RELATED APPLICATIONS

This application is a continuation-in-part of application Ser. No. 960,941, filed on Oct. 14, 1992, now U.S. Pat. No. 5,339,552, which in turn is a continuation-in-part of application Ser. No. 817,750, filed on Jan. 7, 1992, now U.S. Pat. No. 5,334,224.

FIELD OF THE INVENTION

This invention relates generally to improved belt-indication assemblies.

BACKGROUND OF THE INVENTION

The above-referenced pending patent applications set forth, in one aspect, a method for the making of belts through the use of a belt buckle having a prong pivotally supported on an open frame of the buckle, a belt blank having a prong-passage opening therethrough at a location distal from a first end of the belt blank, and a belt-retaining loop member. The method, in such one aspect, comprises the steps of:

(a) inserting the first end of the belt blank through the buckle open frame;

(b) folding the belt blank onto itself about a fold line extending through the belt blank prong-passage opening and inserting the buckle prong through the prong-passage opening;

(c) providing a marketing indicator with an adhesive backing selected to adhere to the belt blank;

(d) adhering the marketing indicator to the belt blank within the fold of the belt blank at a first location using the adhesive backing;

(d) applying the belt-retaining loop member to the folded belt blank at least in part within the fold of the belt blank at a second location to provide an unsecured assembly of the folded belt blank, the buckle, the marketing indicator and the belt-retaining loop member;

(f) inverting the unsecured assembly of the folded belt blank, the buckle, the marketing indicator and the belt-retaining loop member; and (g) securing the inverted secured assembly of the folded belt blank, the buckle, the marketing indicator and the belt-retaining loop member.

The method, in its step (g) is practiced in a manner whereby the stitching creates a line of perforations in the marketing indicator which facilitates removal of the marketing indicator by tearing across the line of perforations.

Applicants have found that, for particularly narrow width belts, wherein adjacent stitches are made closer than for wider belts, the perforations are so close as to render the marketing indicator too readily removable. Thus, the area retaining the exposed marketing indicator with its parent unperforated part within the fold becomes quite limited, resulting in a less than desired assembly. In particular, applicants have reached an optional material for the marketing indicator strip member, i.e., polyesters, such as polyethyleneterephthalate (PET). This material selection, as is discussed in the second above-referenced application, is based on its characteristic of not taking on a permanent curvature set in the course of reeling marketing indicators.

However, when perforated, polyesters tend to be readily tearable in the high density perforation setting arising in narrow width belts.

SUMMARY OF THE INVENTION

The present invention has as its primary object the provision of improved marketing indicator assemblies for use with narrow belts.

In attaining the above and other objects, the invention provides a marketing indicator arrangement for application to a belt, comprising a strip member having first and second opposed ends, an adhesive layer disposed on a first side of the strip member at the first end thereof, the strip member supporting belt marketing indicia on a second side thereof opposite the adhesive layer and at a location distal from the first end thereof, and a further layer adhered to the second side of the strip member. The marketing indicator arrangement preferably includes a protective layer disposed on the adhesive layer. Further, the marketing indicator arrangement has an additional layer comprised of a material less susceptible to tearing upon perforation thereof following stitching through the marketing indicator than is the strip member.

The foregoing and other objects and features of the invention will be further evident from the following detailed description of preferred embodiments thereof and from the drawings in which like components are identified by like reference numerals throughout.

DETAILED DESCRIPTION OF PREFERRED EMBODIMENTS AND PRACTICES

Figure 2:
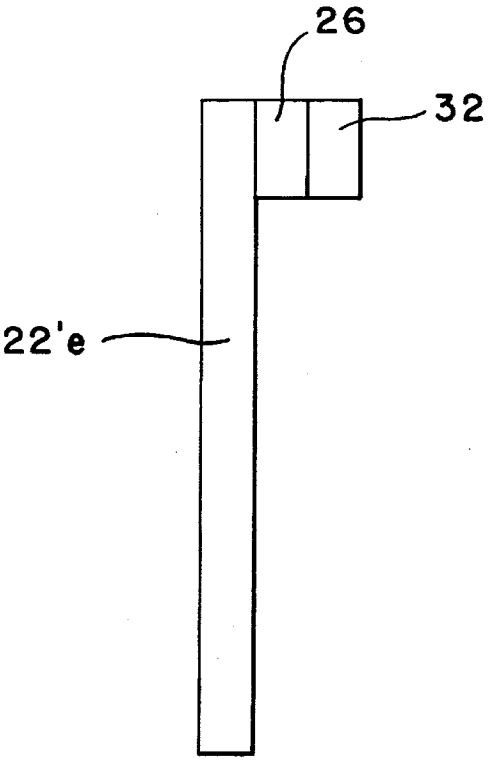
FIG. 2 (PRIOR ART)
FIGS. 1 and 2 replicate drawings of the second above-noted commonly-assigned patent application.
Figure 1:
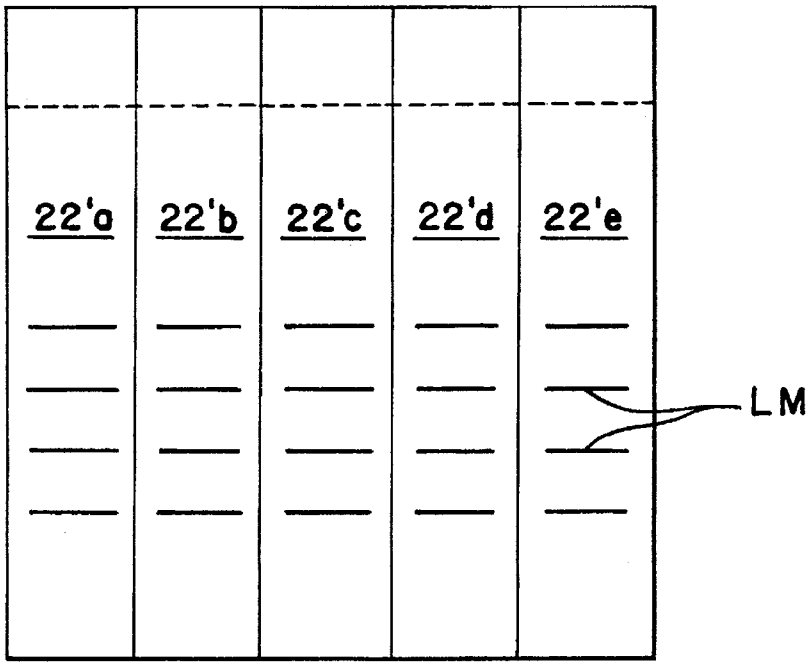
FIG. 1 (PRIOR ART)

Referring to FIGS. 1 and 2, marketing indicators **22'*a* through 22'*e* include an adhesive layer 26 on the rear surface, with protective layer and support member 32 adhered to the adhesive layer. On their front sides, the marketing indicators include lines of marketing indicia indicated as LM. As is disclosed in the second above-referenced parent application, a reeled arrangement is disposed adjacent a belt making station and an operator simply peels indicators from support member 32 and applies them to belts with adhesive layer 26** retaining the indicator with the belt blank.

Figure 4:
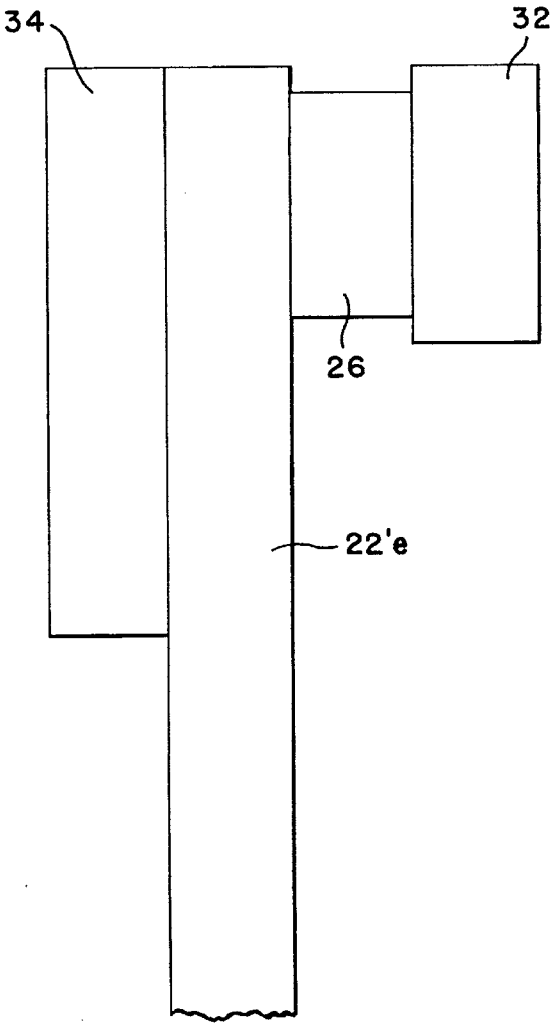
FIG. 4 is a right side elevation of the marketing indicator arrangement of FIG. 3.
Figure 3:
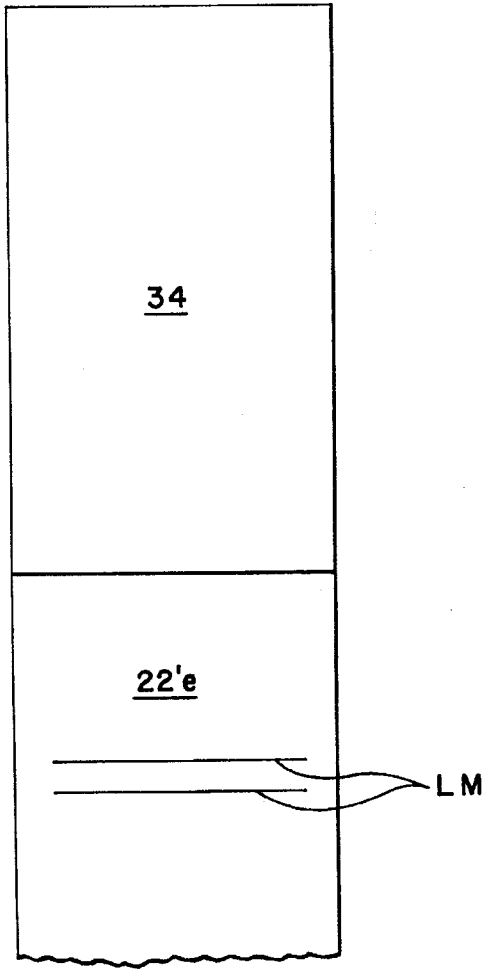
FIG. 3 is a front elevation of a marketing indicator arrangement in accordance with the subject invention.

Referring to FIGS. 3 and 4, the marketing indicator arrangement for application to a belt therein comprises a strip member **22'*e* having first and second opposed ends, an adhesive layer 26 disposed on a first side of the strip member at the first end thereof, the strip member supporting belt marketing indicia LM on a second side thereof opposite the adhesive layer and at a location distal from the first end thereof. Protective layer 32 is adhered to adhesive layer 26**.

A further layer 34 is disposed on the second side of the strip member and extends at least coextensively longitudinally with adhesive layer 26 and is fixedly adhered to the strip member. Layer 34 is comprised of a material less susceptible to tearing following stitching through the marketing indicator than the strip member.

In a preferred selection of materials for the strip member and layer 34, the former is constituted of a four mil thick PET film and layer 34 is constituted of a two mil thick polypropylene film. In terms of other dimensioning, layer 32 is a three mil thick film and adhesive layer is two mil thick. The components are dimensioned lengthwise as shown in FIG. 4, i.e., layer 32 is of length greater than adhesive 26 to provide protection thereof. Layer 34 extends with strip member 22'*e* at least coextensively with the strip member beyond the location at which stitching is done in the assembly of belts. As indicated in FIG. 3, the location of the lower end of layer 34 is distal from the belt marketing indicia LM, being upwardly thereof.

Given the fixed adherence of layer 34 with the strip member, such as by heat-laminating the former to the latter, and applicants' reliance on the characteristic of polyproplene to evidence far less tearability upon performation definition than polyester in the course of stitching through the combined structure, the invention provides improved marketing indicator assemblies for dense stitching environments, as in the case of narrow width belts.

Various changes in structure to the described marketing indicator and practices connected therewith may evidently be introduced without departing from the invention. Accordingly, it is to be understood that the particularly disclosed and depicted embodiments and practices are intended in an illustrative and not in a limiting sense. The true spirit and scope of the invention is set forth in the following claims.

What is claimed is:

1. A marketing indicator arrangement for application to a belt by stitching, comprising an elongate strip member having first and second opposed ends, an adhesive layer disposed on a first side of said strip member at said first end thereof, said strip member supporting belt marketing indicia on a second side thereof opposite said adhesive layer and at a location distal from said first end of said strip member, and a further layer disposed on said second side of said strip member at said first end of said strip member, said further layer extending longitudinally with said strip member to a further location distal from said belt marketing indicia.

2. The marketing indicator arrangement of claim 1, wherein said further layer is comprised of a material less susceptible to tearing upon stitching therethrough than said strip member.

3. The marketing indicator arrangement of claim 1, further including a protective layer disposed on said adhesive layer.

4. The marketing indicator arrangement of claim 3, wherein said further layer is comprised of a material less susceptible to tearing upon stitching therethrough than said strip member.

5. The marketing indicator arrangement of claim 1 wherein said strip member is comprised of a polyester film and wherein said further layer is comprised of a polyproplene film.

6. The marketing indicator arrangement of claim 5 wherein said strip member is comprised of polyethylene teraphthalate.

* * * * *